US010773926B2

(12) United States Patent
Zhao

(10) Patent No.: US 10,773,926 B2
(45) Date of Patent: Sep. 15, 2020

(54) ELEVATOR BELT WITH ADDITIVE LAYER

(71) Applicant: OTIS ELEVATOR COMPANY, Farmington, CT (US)

(72) Inventor: Wenping Zhao, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/944,339

(22) Filed: Apr. 3, 2018

(65) Prior Publication Data

US 2018/0282125 A1 Oct. 4, 2018

Related U.S. Application Data

(60) Provisional application No. 62/480,864, filed on Apr. 3, 2017.

(51) Int. Cl.
*B66B 7/06* (2006.01)
*B66B 9/00* (2006.01)
(Continued)

(52) U.S. Cl.
CPC ..... *B66B 7/062* (2013.01); *B66B 9/00* (2013.01); *D07B 1/16* (2013.01); *D07B 1/162* (2013.01);
(Continued)

(58) Field of Classification Search
CPC .. B66B 7/062; B66B 9/00; D07B 1/16; D07B 1/162; D07B 5/002
See application file for complete search history.

(56) References Cited

U.S. PATENT DOCUMENTS 8,525,033 B2 * 9/2013 Grether ..... D07B 1/02 174/128.1
2008/0171823 A1 * 7/2008 Rafailovich ..... C08K 7/24 524/495
(Continued)

FOREIGN PATENT DOCUMENTS

CN 103903772 A 7/2014
CN 105185437 A 12/2015
(Continued)

OTHER PUBLICATIONS

European Office Action Issued in EP Application No. 18165552.3, dated Sep. 13, 2018, 8 Pages.

*Primary Examiner* — Michael A Riegelman
(74) *Attorney, Agent, or Firm* — Cantor Colburn LLP

(57) ABSTRACT

A belt for an elevator system includes a plurality of tension members arranged along a belt width and extending longitudinally along a length of the belt, a jacket material at least partially encapsulating the plurality of tension members, and a primary overlay layer applied to one or more of the plurality of tension members or at least a portion of the jacket material. An elevator system includes a hoistway, an elevator car movable therein, and a belt operably connected to the elevator car to suspend and/or drive the elevator car along the hoistway. The belt includes a plurality of tension members arranged along a belt width and extending longitudinally along a belt length, a jacket material at least partially encapsulating the plurality of tension members, and a primary overlay layer applied to one or more of the plurality of tension members or at least a portion of the jacket material.

13 Claims, 4 Drawing Sheets

(51) Int. Cl.
*D07B 1/16* (2006.01)
*D07B 5/00* (2006.01)
*D07B 1/22* (2006.01)

(52) U.S. Cl.
CPC ..... *D07B 5/002* (2013.01); *D07B 1/22* (2013.01); *D07B 5/006* (2015.07); *D07B 2201/2033* (2013.01); *D07B 2201/2044* (2013.01); *D07B 2201/2046* (2013.01); *D07B 2201/2088* (2013.01); *D07B 2201/2089* (2013.01); *D07B 2201/2092* (2013.01); *D07B 2201/2095* (2013.01); *D07B 2205/205* (2013.01); *D07B 2205/2046* (2013.01); *D07B 2205/3003* (2013.01); *D07B 2205/3007* (2013.01); *D07B 2401/2035* (2013.01); *D07B 2501/2007* (2013.01)

(56) References Cited

U.S. PATENT DOCUMENTS

2010/0133046 A1* 6/2010 Allwardt ..... B66B 7/08 187/251
2011/0259677 A1* 10/2011 Dudde ..... B66B 7/062 187/411
2012/0329591 A1* 12/2012 Goeser ..... B66B 7/062 474/238
2015/0191331 A1* 7/2015 Orelup ..... D07B 1/22 428/76
2015/0307321 A1* 10/2015 Breite ..... D07B 1/02 187/254
2015/0348668 A1* 12/2015 Niu ..... H01B 1/04 174/72 R
2016/0145863 A1* 5/2016 Bergman ..... E04B 9/225 52/506.05
2016/0325966 A1* 11/2016 Papas ..... B66B 7/062
2017/0057787 A1* 3/2017 Zhao ..... B66B 7/062
2017/0101293 A1* 4/2017 Eastman ..... B66B 7/062
2017/0284503 A1* 10/2017 Goser ..... B66B 7/062
2018/0155870 A1* 6/2018 Eastman ..... D07B 1/162
2018/0162695 A1* 6/2018 Eastman ..... B32B 5/022
2018/0251342 A1* 9/2018 Eastman ..... B66B 7/062
2018/0282125 A1* 10/2018 Zhao ..... D07B 1/16
2018/0305178 A1* 10/2018 Martin ..... B66B 7/062
2018/0305181 A1* 10/2018 Zhao ..... B66B 7/062
2018/0305182 A1* 10/2018 Zhao ..... F16G 5/10
2018/0339473 A1* 11/2018 Zhao ..... B64D 15/12
2019/0062115 A1* 2/2019 Zhao ..... B66B 7/062
2019/0062117 A1* 2/2019 Zhao ..... B66B 7/062
2019/0071281 A1* 3/2019 Zhao ..... B66B 7/062
2019/0084803 A1* 3/2019 Eastman ..... B66B 7/062
2019/0168999 A1* 6/2019 Guilani ..... B66B 7/062
2019/0218063 A1* 7/2019 Gurvich ..... B66B 7/1238

FOREIGN PATENT DOCUMENTS

DE 102014217309 A1 3/2016
WO 03070821 A2 8/2003
WO 2010019151 A1 2/2010
WO 2010072690 A1 7/2010
WO 2013055328 A1 4/2013
WO 2014014456 A1 1/2014
WO 2015134023 A1 9/2015

* cited by examiner

FIG. 2
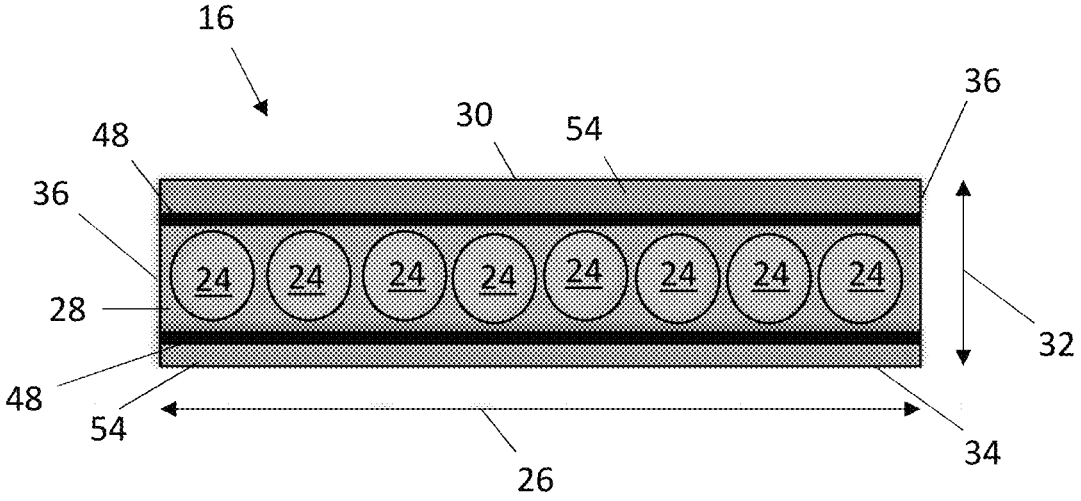
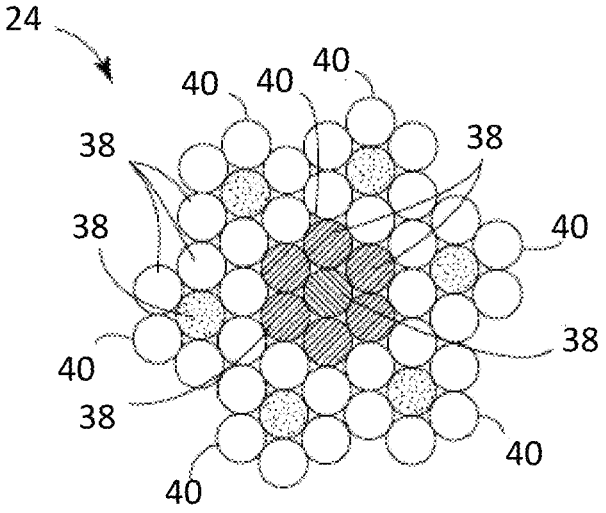
FIG 3

ELEVATOR BELT WITH ADDITIVE LAYER

CROSS-REFERENCE TO RELATED APPLICATIONS

This application claims the benefit of 62/480,864, filed Apr. 3, 2017 which is incorporated herein by reference in its entirety.

BACKGROUND

Embodiments disclosed herein relate to elevator systems, and more particularly to load bearing members to suspend and/or drive elevator cars of an elevator system.

Elevator systems are useful for carrying passengers, cargo, or both, between various levels in a building. Some elevators are traction based and utilize load bearing members such as belts for supporting the elevator car and achieving the desired movement and positioning of the elevator car.

Where a belt is used as a load bearing member, a plurality of tension elements, or cords, are embedded in a common jacket. The jacket retains the cords in desired positions and provide a frictional load path. In an exemplary traction elevator system, a machine drives a traction sheave with which the belts interact to drive the elevator car along a hoistway. Belts typically utilize tension members formed from steel elements, but alternatively may utilize tension members formed from synthetic fibers or other materials, such as carbon fiber composites.

BRIEF DESCRIPTION

In one embodiment, a belt for an elevator system includes a plurality of tension members arranged along a belt width and extending longitudinally along a length of the belt, a jacket material at least partially encapsulating the plurality of tension members, and a primary overlay layer applied to one or more of the plurality of tension members or at least a portion of the jacket material.

Additionally or alternatively, in this or other embodiments the primary overlay layer is formed from a non-woven carbon nanotube sheet.

Additionally or alternatively, in this or other embodiments the carbon nanotubes are multi-walled carbon nanotubes.

Additionally or alternatively, in this or other embodiments the primary overlay layer is formed from an intrumenscent material.

Additionally or alternatively, in this or other embodiments a secondary overlay layer is applied over the primary overlay layer.

Additionally or alternatively, in this or other embodiments the secondary overlay layer defines a traction surface of the belt.

Additionally or alternatively, in this or other embodiments the secondary overlay layer is an elastomeric material.

Additionally or alternatively, in this or other embodiments the primary overlay layer is formed at the plurality of tension members by one or more of wrapping, dipping, spraying, laminating or pultrusion process.

Additionally or alternatively, in this or other embodiments the primary overlay layer is configured to improve thermal performance of the belt.

In another embodiment, an elevator system includes a hoistway, an elevator car located in the hoistway and movable therein, and a belt operably connected to the elevator car to suspend and/or drive the elevator car along the hoistway. The belt includes a plurality of tension members arranged along a belt width and extending longitudinally along a length of the belt, a jacket material at least partially encapsulating the plurality of tension members, and a primary overlay layer applied to one or more of the plurality of tension members or at least a portion of the jacket material.

Additionally or alternatively, in this or other embodiments the primary overlay layer is formed from a non-woven carbon nanotube sheet.

Additionally or alternatively, in this or other embodiments the carbon nanotubes are multi-walled carbon nanotubes.

Additionally or alternatively, in this or other embodiments the primary overlay layer is formed from an intrumenscent material.

Additionally or alternatively, in this or other embodiments a secondary overlay layer is applied over the primary overlay layer.

Additionally or alternatively, in this or other embodiments the secondary overlay layer defines a traction surface of the belt.

BRIEF DESCRIPTION OF THE DRAWINGS

The following descriptions should not be considered limiting in any way. With reference to the accompanying drawings, like elements are numbered alike:

FIG. 2 is a schematic cross-sectional view of an embodiment of an elevator system belt;

FIG. 3 is a cross-sectional view of an embodiment of a tension member for an elevator belt;

DETAILED DESCRIPTION

A detailed description of one or more embodiments of the disclosed apparatus and method are presented herein by way of exemplification and not limitation with reference to the Figures.

Figure 1:
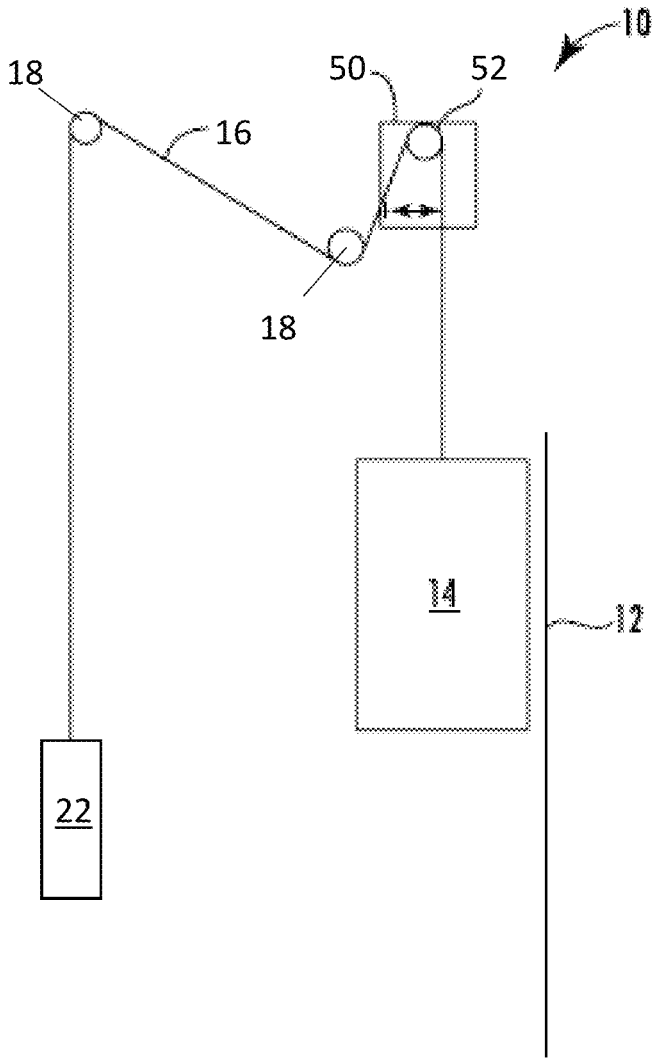
FIG. 1 is a schematic illustration of an embodiment of an elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a traction sheave 52. The traction sheave 52 is driven by a machine 50. Movement of drive sheave by the machine 50 drives, moves and/or propels (through traction) the one or more belts 16 that are routed around the traction sheave 52. At least one of the sheaves 18 could be a diverter, deflector or idler sheave. Diverter, deflector or idler sheaves are not driven by a machine 50, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 or only one side of the one or more belts 16 engages the one or more sheaves 18. The embodiment of FIG. 1 shows a 1:1 roping arrangement in which the one or more belts 16 terminate at the car 12 and counterweight 22, while other embodiments may utilize other roping arrangements.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

FIG. 2 provides a cross-sectional schematic of an exemplary belt 16 construction or design. The belt 16 includes a plurality of tension members 24 extending longitudinally along the belt 16 and arranged across a belt width 26. The tension members 24 are at least partially enclosed in a jacket material 28 to restrain movement of the tension members 24 in the belt 16 and to protect the tension members 24. The jacket material 28 defines a traction side 30 configured to interact with a corresponding surface of the traction sheave 52. Exemplary materials for the jacket material 28 include the elastomers of thermoplastic and thermosetting polyurethanes, polyamide, thermoplastic polyester elastomers, and rubber, for example. Other materials may be used to form the jacket material 28 if they are adequate to meet the required functions of the belt 16. For example, a primary function of the jacket material 28 is to provide a sufficient coefficient of friction between the belt 16 and the traction sheave 52 to produce a desired amount of traction therebetween. The jacket material 28 should also transmit the traction loads to the tension members 24. In addition, the jacket material 28 should be wear resistant and protect the tension members 24 from impact damage, exposure to environmental factors, such as chemicals, for example.

The belt 16 has a belt width 26 and a belt thickness 32, with an aspect ratio of belt width 26 to belt thickness 32 greater than one. The belt 16 further includes a back side 34 opposite the traction side 30 and belt edges 36 extending between the traction side 30 and the back side 34.

Figure 4:
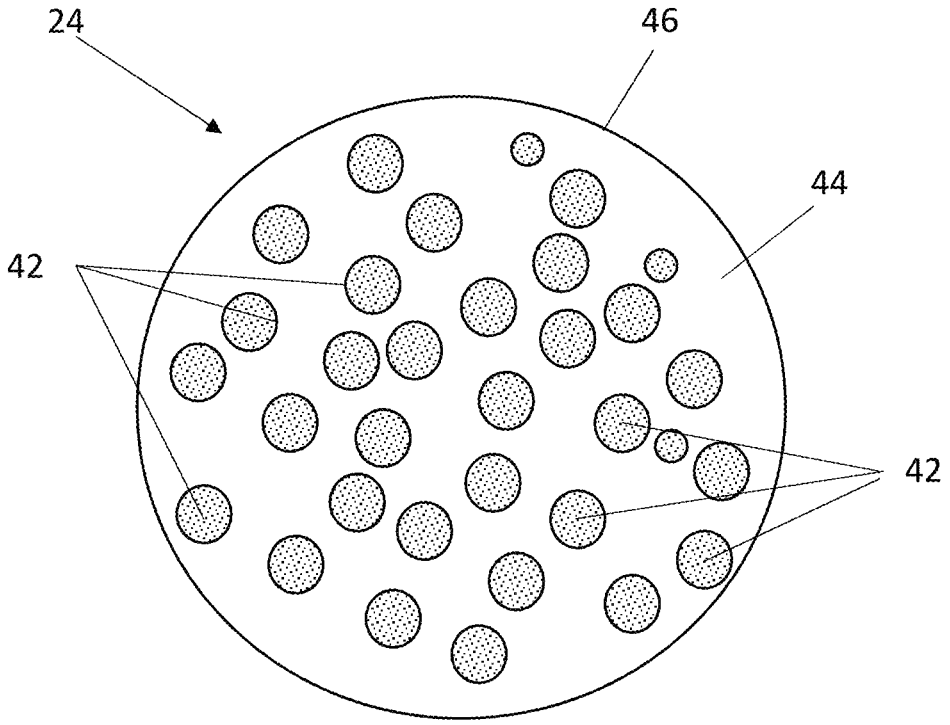
FIG. 4 is a another cross-sectional view of an embodiment of a tension member for an elevator belt.

As shown in FIG. 3, in some embodiments, the tension members 24 are cords formed from a plurality of steel wires 38, which may be arranged into strands 40. Alternatively, referring to FIG. 4, the tension members 24 may be formed from synthetic fibers or from a composite constructions, such as a plurality of load-carrying fibers 42 disposed in a matrix material 44.

Exemplary load carrying fibers 42 include, but are not limited to, carbon, glass, aramid, nylon, and polymer fibers, for example. Each of the load carrying fibers 42 may be substantially identical or may vary. In addition, the matrix material 44 may be formed from any suitable material, such as polyurethane, vinylester, and epoxy for example. The materials of the load carrying fibers 42 and the matrix material 44 are selected to achieve a desired stiffness and strength of the tension member 24.

The tension member 24 may be formed as thin layers, in some embodiments by a pultrusion process. In a standard pultrusion process, the load carrying fibers 42 are impregnated with the matrix material 44 and are pulled through a heated die and additional curing heaters where the matrix material 44 undergoes cross linking. A person having ordinary skill in the art will understand that controlled movement and support of the pulled load carrying fibers 42 may be used to form a desired linear or curved profile of the tension member 24. In an exemplary embodiment, the tension member 24 has a cross-sectional thickness of about 0.5 millimeters to about 5 millimeters. Further, in some embodiments the tension member 24 has a circular cross-section, while in other embodiments the tension member 24 may have other cross-sectional shapes, such as rectangular or oval. Further, in some embodiments, the tension members 24 may include a tension element member coating layer 46 to, for example, promote adhesion with the jacket material 28.

While eight tension members 24 are illustrated in the embodiment of FIG. 2, other embodiments may include other numbers of tension members 24, for example, 6, 10 or 12 tension members 24. Further, while the tension members 24 of the embodiment of FIG. 2 are substantially identical, in other embodiments, the tension members 24 may differ from one another in number of wires 38, materials or arrangement.

The belt 16 includes one or more primary overlay layers 48 formed from a carbon nanotube sheet. In some embodiments, the carbon nanotube sheet is a non-woven carbon nanotube sheet, and further may be a non-woven sheet of multi-walled carbon nanotubes. The primary overlay layer 48 is configured to enhance fire and thermal performance of the belt 16, protecting the tension members 24 and the jacket material 28 during a thermal event. While in some embodiments, the primary overlay layer 48 is formed from a carbon nanotube sheet.

In other embodiments the primary overlay layer may be formed from an intrumenscent material to promote char formation and therefore retards heat conduction and flame formation and spread. Examples of intrumenscent materials include a paper formed from such a material, or a coating including an intrumenscent material. Intumenscent coatings may include three halogen-free flame-retardant additives: an acid source such as phase II ammonium polyphosphate, a carbon source such as pentaerythritol, and a blowing agent such as melamine mixed together with flame-retardant fillers and a polymer binder. Aluminum hydroxide ($Al(OH)_3$) and magnesium hydroxide ($Mg(OH)_2$) are examples of flame-retardant fillers.

The primary overlay layer 48 may be applied entirely around a perimeter of the jacket material 28, or on selected surfaces, such as the traction side 30, the back side 34 and/or the belt edges 36. A secondary overlay layer 54 is applied over the primary overlay layer 48 to protect the primary overlay layer 48 from wear or other damage during operation of the elevator system 10. In some embodiments, the secondary overlay layer 54 is applied at the traction side 30 and the back side 34, while in other embodiments the secondary overlay layer 54 is selectably applied to the traction side 30, the back side 34 and/or the belt edges 36. The second overlay layer 54 may be formed from the same material as the jacket material 38 or alternatively may be formed from a different material to enhance traction and wear performance of the belt 16.

Figure 5:
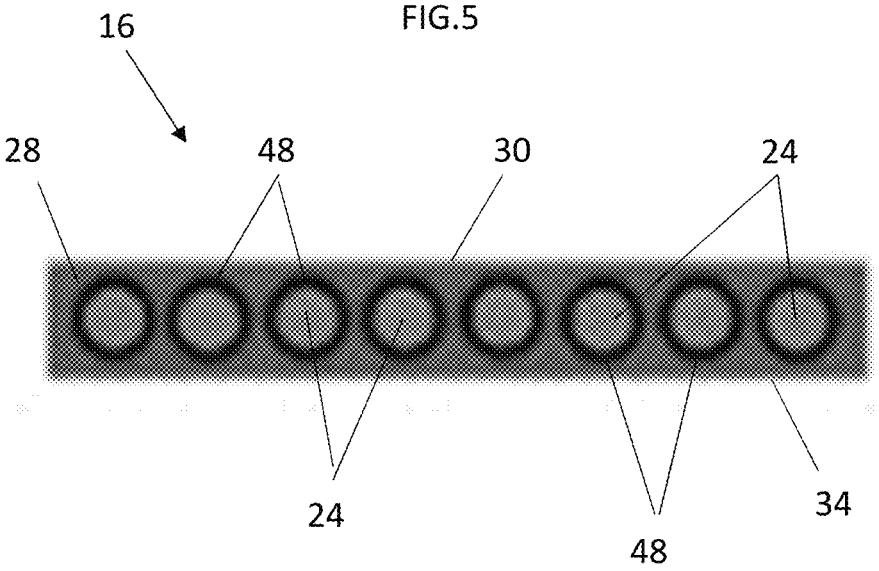
FIG. 5 is another cross-sectional view of an embodiment of an elevator system belt.

Referring now to FIG. 5, in some embodiments the primary overlay layer 48 may be applied to the tension members 24 to protect the tension members 24 directly. Such application of the primary overlay layer 48 may be performed by, for example, wrapping the tension members 24, applying a liquid or solid coating of primary overlay layer 48 to the tension members 24 via, for example, dip or spray processes, or by a lamination process. After application of the primary overlay layer 48 is applied to the tension members 24, subsequent processes such as application of the jacket material 38 are performed to complete the belt 16. Further, the application of the primary overlay layer 48 may be incorporated into a pultrusion process used for formation of the tension members 24.

Figure 6:
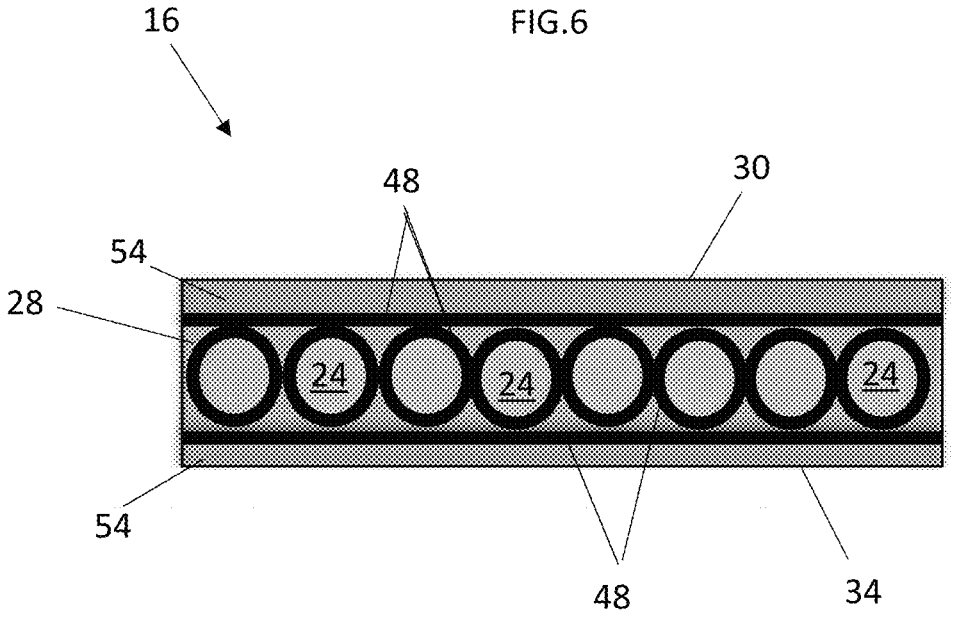
FIG. 6 is yet another cross-sectional view of an embodiment of an elevator system belt.

Referring now to FIG. 6, in some embodiments the primary overlay layer 48 is applied to both the tension members 24 and to the jacket material 38 at, for example, the traction side 30 and the back side 34.

Use of the primary overlay layer 48 improves fire and thermal performance of the belt 16 and maintains friction and traction performance of the belt 16, especially when used in conjunction with the secondary overlay layer 54.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A belt for an elevator system, comprising:

a plurality of tension members arranged along a belt width and extending longitudinally along a length of the belt;

a jacket material at least partially encapsulating the plurality of tension members;

a primary overlay layer having a first portion applied to the plurality of tension members and a second portion applied to the jacket material and extending laterally across the belt width; and a secondary overlay layer applied over the second portion of the primary overlay layer.

2. The belt of claim 1, wherein the primary overlay layer is formed from a non-woven carbon nanotube sheet.

3. The belt of claim 2, wherein the carbon nanotubes are multi-walled carbon nanotubes.

4. The belt of claim 1, wherein the primary overlay layer is formed from an intrumenscent material.

5. The belt of claim 1, wherein the secondary overlay layer defines a traction surface of the belt.

6. The belt of claim 5, wherein the secondary overlay layer is an elastomeric material.

7. The belt of claim 1, wherein the first portion of the primary overlay layer is formed at the plurality of tension members by one or more of wrapping, dipping, spraying, laminating or pultrusion process.

8. The belt of claim 1, wherein the primary overlay layer is configured to improve thermal performance of the belt.

9. An elevator system, comprising:

a hoistway;

an elevator car disposed in the hoistway and movable therein;

a belt operably connected to the elevator car to suspend and/or drive the elevator car along the hoistway, the belt including:

a plurality of tension members arranged along a belt width and extending longitudinally along a length of the belt;

a jacket material at least partially encapsulating the plurality of tension members; and a primary overlay layer having a first portion applied to the plurality of tension members and a second portion applied to the jacket material and extending laterally across the belt width; and a secondary overlay layer applied over the second portion of the primary overlay layer.

10. The elevator system of claim 9, wherein the primary overlay layer is formed from a non-woven carbon nanotube sheet.

11. The elevator system of claim 10, wherein the carbon nanotubes are multi-walled carbon nanotubes.

12. The elevator system of claim 9, wherein the primary overlay layer is formed from an intrumenscent material.

13. The elevator system of claim 9, wherein the secondary overlay layer defines a traction surface of the belt.

* * * * *